United States Patent [19]

Colvin

[11] 4,213,355

[45] Jul. 22, 1980

[54] ADJUSTABLE SOCKET

[76] Inventor: David S. Colvin, 31324 Burbank, Farmington Hills, Mich. 48081

[21] Appl. No.: 17,981

[22] Filed: Mar. 1, 1979

[51] Int. Cl.[2] ..... B25B 13/12

[52] U.S. Cl. ..... 81/128; 279/65; 279/74

[58] Field of Search ..... 81/53, 53.2, 128; 279/1 F, 65, 74, 114, 122

[56] References Cited

U.S. PATENT DOCUMENTS

| | | | |
|---|---|---|---|
| 810,288 | 1/1906 | Le May | 81/128 |
| 1,288,154 | 12/1918 | Palmgren | 279/65 |
| 1,498,040 | 6/1924 | Johnson | 81/53.2 |
| 1,554,963 | 9/1925 | Fisher | 81/128 |
| 2,580,247 | 12/1951 | Secondi et al. | 81/53 |
| 2,582,444 | 1/1952 | Lucht | 81/128 |
| 2,669,896 | 2/1954 | Clough | 81/128 |
| 2,701,489 | 2/1955 | Osborn | 81/53 |
| 2,850,931 | 9/1958 | Conway | 81/128 |
| 2,884,826 | 5/1959 | Bruhn | 81/128 |
| 3,724,299 | 4/1973 | Nelson | 81/128 |

*Primary Examiner*—James G. Smith

*Attorney, Agent, or Firm*—Reising, Ethington, Barnard Perry & Brooks

[57] ABSTRACT

An adjustable socket (10) for rotatively driving bolts and nuts is disclosed as including a plurality of jaws (18) mounted on a rotatable driver (16) for quick action adjustment between fully opened and fully closed positions upon rotation of an adjuster (22) no more than one revolution. Each jaw has an inclined camming surface (28) that is slidably engaged by a jaw positioner (20) upon axial movement thereof in response to rotation of the adjuster so as to provide radial adjustment of the jaw positions. A spring (30) biases the jaws in an outward radial direction into engagement with the positioner. In one embodiment, the jaw positioner comprises a sleeve (20) which preferably has apertures (62) that receive the jaws, and the adjuster has a 360° helical locking surface (26) that cooperates with a 360° locking surface (24) on the driver in an axially opposed relationship to provide locking action and jaw adjustment. Another embodiment of the socket includes a unitary sleeve having a jaw positioner end that slidably engages the camming surfaces on the jaws and an adjuster end that is rotatably adjustable to adjust the jaw positions under the control of axially engaged locking surfaces on the driver and the adjuster end of the sleeve. Combined radial and axial jaw movement upon adjusting prevents jamming in both embodiments.

14 Claims, 18 Drawing Figures

ADJUSTABLE SOCKET

TECHNICAL FIELD

This invenstion relates to an adjustable socket for driving threaded bolts and nuts of different sizes.

BACKGROUND ART

The prior art discloses adjustable sockets for replacing the more conventional socket set which includes a number of different size sockets for driving bolts and nuts of different sizes. Usually such sockets are driven by either a ratchet wrench or a unitary wrench having a bent end that is received within a wrench opening. However, it is also possible to have adjustable sockets that are usuable with straight wrenches having a handle end like a screw driver or slidable wrench handles of the type normally used on hand taps.

Adjustable sockets conventionally include a plurality of jaws that are movable in a radial direction to receive and rotatively drive nuts and bolts of different sizes. The number of positions to which the jaws can be adjusted is usually great enough so that both English and metric size nuts and bolts can be driven by the socket upon appropriate adjustment. Thus, a mechanic can work on any particular job with an adjustable socket without having to constantly remove one socket from the wrench and replace it with another socket. The ever-constant search for a socket of a particular size is also eliminated by adjustable sockets.

The Lucht U.S. Pat. No. 2,582,444 discloses an adjustable socket wherein movable jaws are positioned by a threaded collar that must be rotated A number of revolutions in order to provide jaw adjustment between fully opened and fully closed positions, i.e. the largest and smallest size bolt or nut that can be driven by the adjustable socket. Rotating the threaded collar a number of times to provide the adjustment is time consuming just like removing one socket from the wrench and replacing it with another socket as is done with socket sets.

The Fisher U.S. Pat. No. 1,554,963, Conway U.S. Pat. No. 2,850,931, and Bruhn U.S. Pat. No. 2,884,826 disclose adjustable sockets that utilize pin and slot adjusters for providing adjustment of movable jaws between fully opened and closed positions. Such pin and slot connections require a locking action to be provided for controlling the position of the pin in the associated slot and necessarily increase the complexity of the socket.

Other adjustable sockets and the like are disclosed by U.S. Pat. Nos. to Johnson, 1,498,040; Secondi et al, 2,580,247; Clough, 2,669,896; Osborn, 2,701,489; Livermont, 3,102,732; and Nelson, 3,724,299.

An object of the present invention is to provide an adjustable socket having jaws that are mounted for radial movement between fully opened and fully closed positions by quick action adjustment of one revolution or less.

In carrying out the above object and other objects of the invention the adjustable socket includes a rotational driver on which a plurality of jaws are mounted for radial movement and each of the jaws includes a camming surface that is inclined in a radial direction along the axis of driver rotation. A jaw positioner is movable axially on the driver to slidably engage the camming surfaces on the jaws in order to control the radial positions of the jaws and the size of a nut or bolt capable of being received and rotatively driven by the jaws under the impetus of driver rotation. A rotatable adjuster of the socket is provided to move the jaw positioner axially in order to provide the jaw movement between the fully opened and fully closed positions upon rotation of one revolution or less. At least one helical locking surface of the socket extends about the axis of driver rotation an angular amount equal to the extent of adjuster rotation so as to provide locking of the adjuster and hence the jaw positioner and the jaws in any adjusted position. A spring of the socket preferably biases the jaws in an outward radial direction into engagement with the jaw positioner.

In one preferred embodiment of the adjustable socket, the jaw positioner and the adjuster are separate components that are each mounted on the driver. The jaw positioner includes a sleeve that is slidably engaged with the camming surfaces on the jaws and moved axially on the driver by rotation of the adjuster. A helical locking surface on the driver extends about the rotational axis thereof for an angle of no more than 360° and is engaged by a helical locking surface on the adjuster to lock the adjuster in any selected rotational position thereof and thereby lock the jaw positioner sleeve against axial movement and hence lock the jaws against outward radial movement.

The adjustable socket embodiment including the separate jaw positioner sleeve and adjuster preferably has the helical locking surfaces on the driver and the adjuster engaged in an axially facing relationship and also has the camming surfaces on the jaws inclined inwardly toward the axis of driver rotation in a direction away from a wrench end of the driver opposite a jaw support end on which the jaws are mounted for their radial movement. Radial slots in the jaw support end of the driver receive the jaws in an axially captured relationship. Sleeve movement toward the wrench end of the driver moves the jaws inwardly while spring action biases the jaws outwardly into engagement with the sleeve so as to provide outward jaw movement upon sleeve movement away from the wrench end of the driver. Apertures are provided in the jaw positioner sleeve to receive the jaws so as to permit the sleeve to be lightweight while still having the requisite strength. An annular flange on the sleeve axially engages the rotatable adjuster to coordinate the movements of the sleeve and the adjuster. The spring which biases the jaws outwardly moves the sleeve axially away from the wrench end of the driver by a camming action upon adjuster rotation in an opening direction. A mounting end of the spring is supported by the jaw support end of the driver centrally between the jaws and includes a plurality of legs that respectively engage the jaws to provide the outward radial bias.

Another preferred embodiment of the adjustable socket includes a unitary sleeve that is mounted on the rotatable driver for axial and rotational movement and has jaw positioner and adjuster ends for cooperatively providing radial adjustment of the jaws on the socket. The jaw positioner end of the sleeve slidably engages the camming surfaces on the jaws which are mounted on a jaw support end of the driver opposite a wrench end thereof at which the driver is rotatively driven. Helical locking surfaces on the driver and the adjuster end of the unitary sleeve each extend about the axis of driver rotation for an associated angle of no greater than 360° and engage each other so as to provide locking of the sleeve in any rotational position as well as quick action adjustment between fully opened and fully closed positions of the jaws upon sleeve rotation of no more than one revolution.

In the embodiment of the adjustable socket including the unitary sleeve having jaw positioner and adjuster ends, the helical locking surface on the driver preferably faces axially toward the jaws and the helical locking surface on the adjuster end of the sleeve faces axially toward the wrench end of the driver in engagement with the helical locking surface on the driver. The camming surfaces on the jaws are inclined inwardly in a radial direction toward the wrench end of the driver. Axial sleeve movement away from the wrench end of the driver upon rotation of the sleeve in one direction thus moves the jaws inwardly toward each other. Sleeve rotation in the other direction allows a spring which is mounted on the jaw support end of the driver to move the jaws outwardly and provide a camming action that moves the sleeve axially toward the wrench end of the driver. A frustoconical surface on the positioner end of the sleeve engages the camming surfaces on the jaws to facilitate the camming action of the sleeve upon the outward jaw movement. The spring which biases the jaws outwardly has a mounting end supported on the driver and a plurality of legs that respectively engage the jaws to provide their outward bias. Radial slots that receive the jaws in an axially captured relationship extend outwardly from an axial hole in the driver for receiving the spring.

In both preferred embodiments of the adjustable socket, each axially engaged locking surface is undulated, knurled or otherwise roughened so as to provide the locking action of the socket in any adjusted position. The jaws of each embodiment move with a combined axial and radial movement upon adjustment. Each jaw camming surface is perpendicular to the direction of combined radial and axial movement thereof so as to prevent jamming during the jaw adjustment. Frustoconical end surfaces of both drivers slidably engage the jaws to also prevent jamming. Also, the spring of each embodiment is the last component assembled and is mounted on the driver with the jaws in an intermediate or fully opened position. After mounting of the spring, the spring prevents inward jaw movement to a sufficient extent that would permit disassembly.

The objects, features, and advantages of the present invention are readily apparent from the following description of the best modes for carrying out the invention when taken in connection with the accompanying drawings.

BEST MODE FOR CARRYING OUT THE INVENTION

Figure 1:
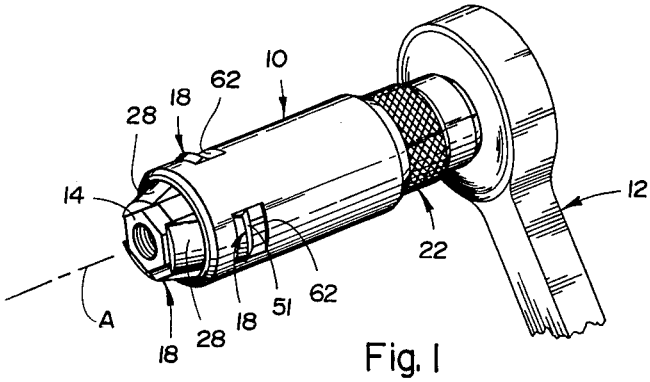
FIG. 1 is a perspective view illustrating one embodiment of an adjustable socket constructed in accordance with the present invention and being used with a conventional ratchet wrench.

Referring to FIG. 1 of the drawings, one embodiment of an adjustable socket constructed in accordance with the present invention is indicated collectively by the reference numeral 10 and is illustrated with a ratchet wrench 12 for use in rotatively driving a nut 14 or a bolt head as well which may be of different sizes. Socket 10, as seen by additional reference to FIG. 2, includes a rotatable driver 16, a plurality of adjustable jaws 18 mounted on the rotatable driver, a jaw positioner including a sleeve 20, and a rotatable adjuster 22. Driver 16 and adjuster 22 include helical locking surfaces 24 and 26, respectively, that engage each other in an axially facing relationship and extend about a rotational axis A of the driver for an angle of 360°. As will be more fully hereinafter described, rotation of the adjuster 22 moves the sleeve 20 axially on the driver 16 so that the sleeve radially positions the jaws 18 by slidably engaging camming surfaces 28 of the jaws in a manner which is hereinafter described. A spring 30 mounted on the driver 16 moves the jaws outwardly when the adjuster 22 is rotated in one direction while concomitantly camming the sleeve 20 toward the left. Similarly, the cooperative action of the locking surfaces 24 and 26 upon rotation of the adjuster 22 in the opposite direction moves the sleeve 20 axially to the right so as to cam the jaws 18 inwardly against the bias of the spring 30.

Figure 3:
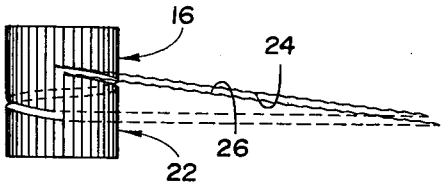
FIG. 3 is a schematic view that illustrates the manner in which locking action and adjustment of the socket is achieved.

As seen by reference to FIG. 3, each of the helical locking surfaces 24 and 26 on the driver 16 and the adjuster 22 is provided with a suitable locking configuration such as undulations, knurls, or other roughening that provides a locking action for preventing relative rotation of the adjuster on the driver when the locking surfaces are engaged with each other. This locking action prevents the outward force which is applied on the jaws 18 during use from camming the sleeve 20 axially so as to permit outward jaw movement and consequent loosening of the grip on the bolt or nut being torqued. Limiting the adjusting rotation of the adjuster 22 on the driver 16 to 360° or less provides for a quick action adjustment of the jaws 18 between fully opened and fully closed positions so as to facilitate use of the adjustable sockets with nuts and bolts of the largest and smallest sizes to be driven by the adjustable socket as well as any intermediate size.

Figure 2:
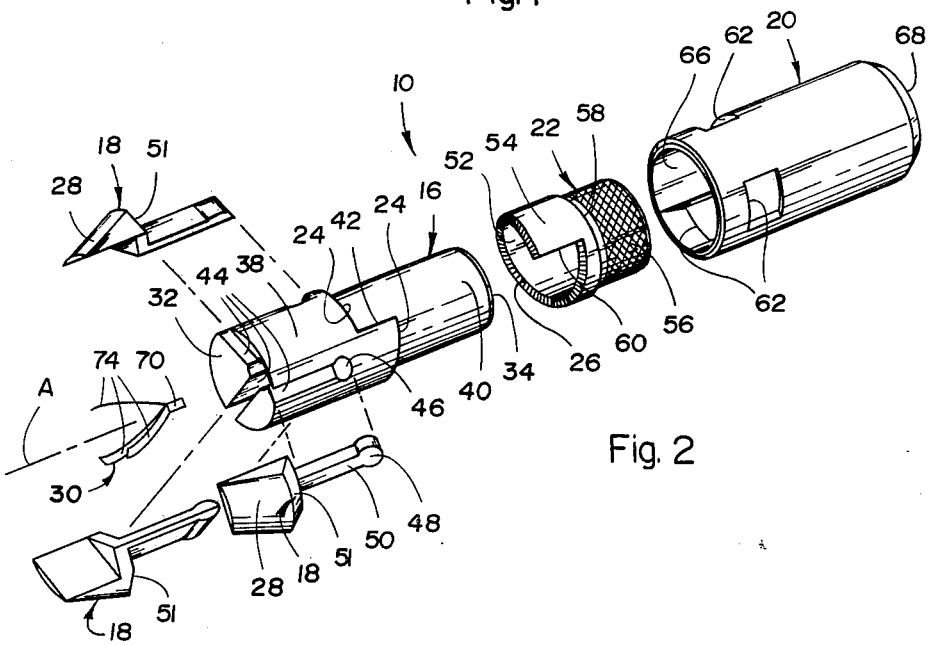
FIG. 2 is an exploded perspective view illustrating the adjustable socket.
Figure 8:
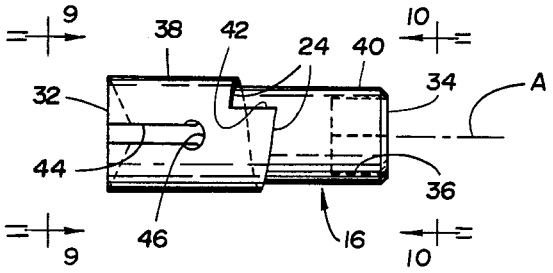
FIG. 8 is a view that illustrates a rotational driver of the socket illustrated in FIGS. 1 through 7.
Figure 9:
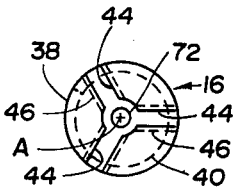
FIGS. 9 and 10 are end views of the driver and are respectively taken along line 9—9 and 10—10 of FIG. 8.
Figure 10:
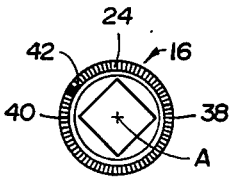

Referring to FIGS. 2 and 8 through 10, the rotatable driver 16 includes a first jaw support end 32 for mounting the jaws 18 shown in FIG. 2 and also includes a second wrench end 34 including a square wrench opening 36 (FIG. 10) for receiving an output driver of the ratchet wrench 12 shown in FIG. 1. As best seen in FIGS. 8 and 10, the helical locking surface 24 of the rotatable driver 16 faces axially away from the jaw support end 32 toward the wrench end 34 and it will also be noted that the jaw support end has a round outer surface 38 that is of a larger diameter than the round outer surface 40 of the wrench end due to the axial extent of the helical locking surface 24. An axially extending surface 42 connects the opposite ends of the helical locking surface 24 as shown in FIG. 8. Jaw support end 32 includes three radial slots 44 for respectively receiving the jaws 18 during assembly of the adjustable socket. It will be noted that each slot 44 has an enlarged inner end 46 for receiving the enlarged distal end 48 of a mounting lug 50 on the associated jaw. As seen best in FIGS. 2, 6, and 8, the jaw support end 32 of the driver 16 has a frustoconical shape that points toward the wrench end 34 of the driver, and a slide surface 51 on each jaw and the inner end 46 of each jaw slot 44 is inclined at a similar angle so that each jaw moves with a combined radial and axial movement. The camming surface 28 of each jaw 18 is perpendicular to its slide surface and direction of combined radial and axial movement so as to prevent jamming of the jaws upon adjustment as is more fully hereinafter described.

Figure 11:
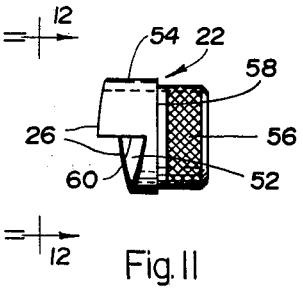
FIG. 11 is a view that shows a rotational adjuster of the socket illustrated in FIGS. 1 through 7.
Figure 12:
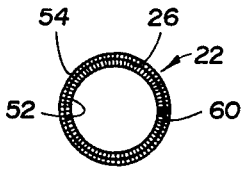
FIG. 12 is an end view of the adjuster taken along line 12—12 of FIG. 11.

Reference should now be made to FIGS. 2, 11, and 12 which illustrate the adjuster 22 on which the helical locking surface 26 is provided. Adjuster 22 also has a sleeve-like construction whose round inner surface 52 is of an appropriate diameter to be slidably received on the round surface 40 of the wrench end 34 on the rotatable driver 16. At its left end as viewed in FIG. 11, the adjuster 22 has a large diameter surface 54 of a rolled triangular shape with a diameter equal to that of the round surface 38 (FIG. 8) on the jaw support end 32 of the rotatable driver 16. The right end of the adjuster 22 is of a smaller diameter than the surface 54 and is provided with a knurled surface 56 to facilitate manual rotation during adjustment of the socket. An axial surface 58 of the adjuster 22 faces toward the right as shown in FIG. 2 and is located between the larger and smaller diameters of the surface 54 and the knurled end 56. Another surface 60 extends between the opposite ends of the helical locking surface 26 which faces to the left as shown in FIG. 11. Upon assembly, the wrench end 34 of the rotatable driver 16 shown in FIG. 8 is inserted through the left end of the adjuster 22 shown in FIG. 11 so as to provide mounting of the adjuster on the driver for both rotational and axial movement.

Figure 4:
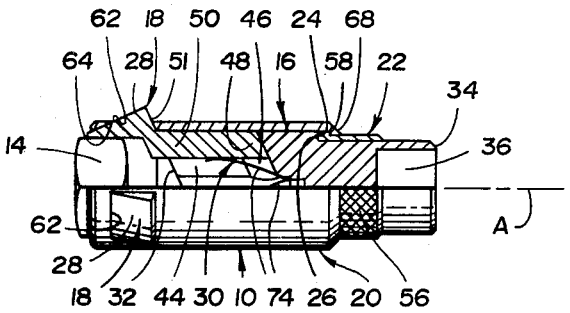
FIG. 4 is a side, half-sectional view illustrating the adjustable socket of FIGS. 1 and 2 with the socket shown in a fully opened position.
Figure 5:
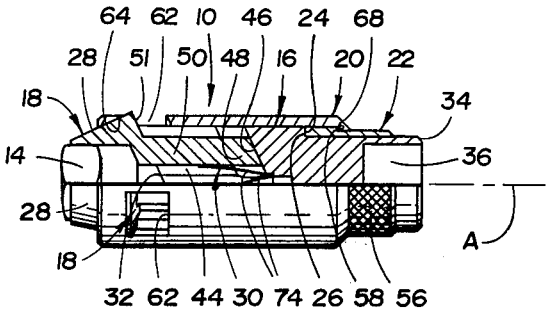
FIG. 5 is a view of the socket similar to that of FIG. 4 but shown in an intermediate position of adjustment.
Figure 6:
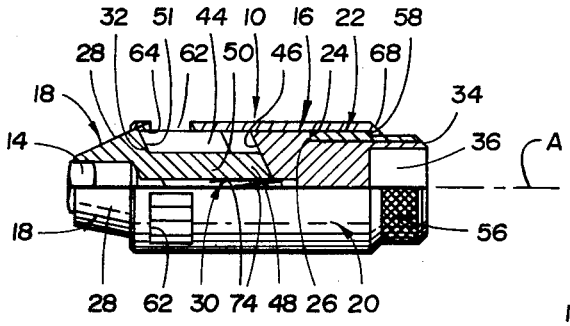
FIG. 6 is a view of the socket similar to FIG. 4 but shown in a fully closed position.

As seen by combined reference to FIGS. 1, 2, and 4 through 7, the jaw positioner sleeve 20 includes three equally spaced apertures 62 that respectively receive the jaws 18 as the jaws are moved from the fully closed position of the socket shown in FIG. 6 to the fully opened position shown in FIG. 4. A camming surface 64 of the sleeve adjacent each opening 62 thereof slidably engages the associated camming surface 28 on the adjacent jaw 18 so as to provide the control of the radial jaw movement upon axial movement of the sleeve 20. The camming surfaces 28 of the jaws and the camming surfaces 64 of the jaw positioner sleeve are inclined inwardly in a direction away from the wrench end 34 of the driver 16 so that axial movement of the sleeve 20 toward the wrench end moves the jaws 18 inwardly toward the fully closed position while axial movement of the sleeve toward the jaw support end 32 allows the spring 30 to move the jaws outwardly toward the fully opened position. The perpendicular relationship of camming surfaces 28 and 64 with respect to the combined radial and axial jaw movement prevents jamming of the jaws as the adjustment takes place since the camming force applied to each jaw is always directed along the direction of jaw movement.

Figure 13:
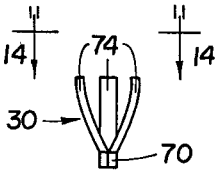
FIG. 13 is a view which illustrates a spring of the adjustable socket.
Figure 14:
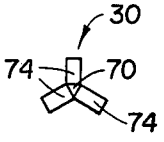
FIG. 14 is a view of the spring taken along line 14—14 of FIG. 13.

The round inner surface 66 of the jaw positioner sleeve 20 is seen in FIG. 2 and has a diameter slightly larger than the diameter of the larger round surface 38 on the driver 16 and slightly larger than the diameter of the surface 54 on the adjuster 22 so as to permit the sleeve to be slid over the adjuster 22 after the adjuster has been first positioned on the driver. It should be noted that this positioning of the sleeve takes place after the jaws 18 have already been positioned within the radial slots 44 in the rotatable driver 16 but before the spring 30 has been mounted on the driver. This sequential order of the assembly is important because the size of the inner surface on the sleeve 20 is just large enough to permit its left end as shown in FIGS. 4 through 5 to pass over the outer ends of the jaw camming surfaces 28 when the jaws are moved as far inwardly as possible without the spring 30 mounted on the rotatable driver 16. An annular flange 68 on the sleeve 20 limits its movement to the left by engaging the axially facing surface 58 of the adjuster 22. The adjuster 22 is then rotatively positioned so that the jaws 18 can be moved outwardly for mounting of the spring 30 shown in FIGS. 2, 13, and 14. A mounting end 70 of spring 30 is then prssed into a hole 72 (FIG. 9) in the jaw support end 32 of the driver 16 so that the spring legs 74 respectively engage the jaws 18 to provide an outward radial bias. Thereafter, engagement of the jaw lugs 50 with the spring legs 74 prevents inward jaw movement past the fully closed extreme shown in FIG. 6 and the engagement of the jaw camming surfaces 28 with the sleeve camming surfaces 64 prevents farther sleeve movement to the right and consequent disassembly.

Figure 7:
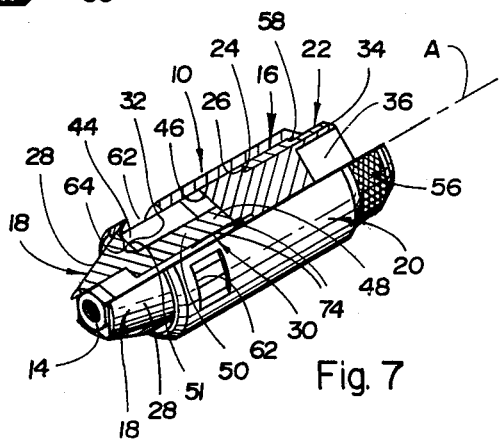
FIG. 7 is a perspective view of the socket shown as in FIG. 6 in its fully closed position.

After assembly of the adjustable socket shown in FIGS. 1 through 14, the socket is movable between the fully opened position illustrated by FIG. 4 and the fully closed position illustrated by FIGS. 6 and 7 by rotation of adjuster 22. In the fully opened positioned of FIG. 4, the axially extending surfaces 42 and 60 (FIG. 2) on the driver 16 and the adjuster 22 are engaged with each other and the axial surface 58 of the adjuster 22 is located as far away from the wrench end 34 of the driver as is permitted. Rotation of the adjuster 22 in one direction moves its surface 60 away from the surface 42 on the driver 16 and thereby moves the adjuster axially due to camming action of the helical locking surfaces 24 and 26 so that the adjuster surface 58 moves the sleeve flange 68 toward the wrench end 34 of the driver. This axial movement of the sleeve 20 through its camming surfaces 64 and the cooperative action of the camming surfaces 28 on the jaws 18 moves the jaws inwardly toward the fully closed position. Adjustment to any intermediate position such as shown in FIG. 5 or the fully closed position of FIGS. 6 and 7 is thus possible by a quick action adjustment involving no more than one revolution of the adjuster 22. In any adjusted position, the locking action between the helical surfaces 24 and 26 prevents axial movement of the sleeve 20 that would permit outward jaw movement and consequent loosening of the grip on the nut or bolt being driven.

When the adjustable socket is moved to the fully closed position shown in FIG. 6, the spring 30 limits the inward jaw movement as previously described and prevents the adjuster from rotating so that the distal axial end of its helical locking surface 26 could pass over the distal axial end of the helical locking surface 24 on the driver and thereby permit the adjuster to rotate more than the limits of one revolution in either direction. Rotation of the adjuster 22 in a direction opposite to the closing direction moves its surface 60 toward the surface 42 of the driver 16 and thereby allows the spring bias of the jaws 18 to move the jaws outwardly and cam the sleeve 20 axially away from the wrench end 34 of the driver as the adjuster likewise moves axially to any selected position. The perpendicular relationship of the camming surfaces 28 and 64 to the combined radial and axial jaw movement prevents jamming of the jaws as adjustment takes place. Once the adjuster 22 is located in any rotational position, the cooperative action of the locking surfaces 24 and 26 prevents the jaws 18 from moving outwardly as torque is applied to a nut or bolt being driven.

Another embodiment of an adjustable socket constructed according to the present invention is collectively indicated by reference numeral 80 in FIGS. 15 through 18 and includes a rotatable driver 82, a plurality of jaws 84 mounted on the driver, and a sleeve 86 that includes a jaw positioner end 88 and an adjuster end 90. Driver 82 includes a jaw support end 92 on which the jaws 84 are mounted and a wrench end 94 that has a square wrench opening 96 for receiving the driver of a ratchet wrench in the same manner described in connection with the previously discussed embodiment. Driver 82 has a helical locking surface 98 that extends about an axis of rotation A thereof for 360° and faces axially toward the jaw support end 92 of the driver away from its wrench end 94. Sleeve 86 also has a helical locking surface 100 that faces axially within its inner confines away from its jaw positioner end 88 so as to be engageable with the driver locking surface 98. Helical locking surface 100 also extends about axis A 360°.

Figure 15:
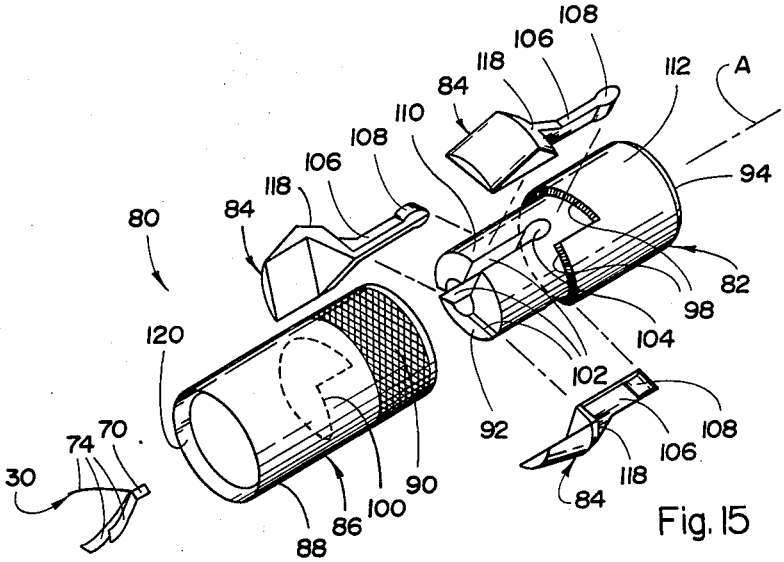
FIG. 15 is an exploded perspective view that illustrates another embodiment of the adjustable socket.
Figure 16:
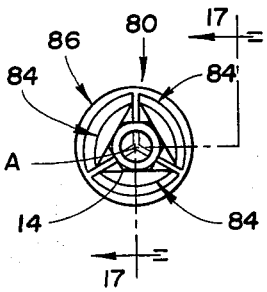
FIG. 16 is an end view of the socket shown in FIG. 15 illustrating the manner in which a nut or bolt is received so as to be rotatively driven upon socket rotation.

As seen by particular reference to FIG. 15, the jaw support end 92 of the driver 82 has a frustoconical shape that points away from the wrench end 94 and includes three radial slots 102 that have enlarged inner ends 104 so as to receive and axially capture mounting lugs 106 with associated enlarged ends 108 in the manner similar to the previously described embodiment. Jaws 84 are supported for combined radial and axial movement like the jaws of the other embodiment to prevent jamming but with an opposite direction of axial inclination. Adjacent the radial jaw slots 102, the driver end 92 has a round surface 110 of a smaller diameter than the round surface 112 at the wrench end 94 of the driver.

Figure 17:
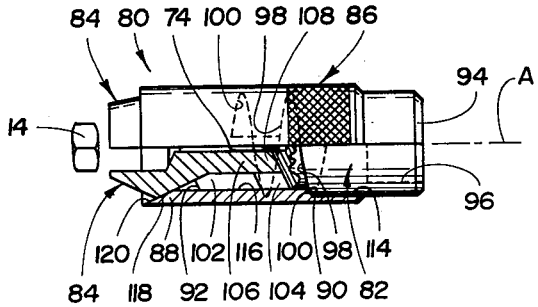
FIG. 17 is a side, half-sectional view of the socket taken along line 17—17 of FIG. 16 with the socket shown in a fully closed position.
Figure 18:
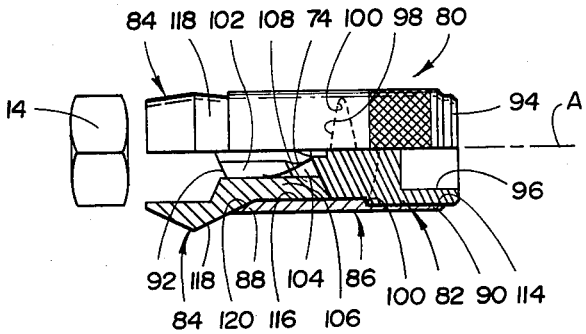
FIG. 18 is a view similar to FIG. 17 illustrating the socket in a fully opened position.

As seen by reference to FIGS. 17 and 18, the sleeve 86 has a round inner surface 114 to the right of its axial locking surface 100 with a diameter just large enough to be slidably received over the round surface on the wrench end 94 of the driver 82. Likewise, the sleeve 86 has an inner surface 116 to the left of its locking surface 100 with a diameter just large enough to be slidably received over the round surface on the jaw support end 94 of the driver 82. Jaws 84 are mounted within the slots 102 prior to mounting of the sleeve 86 on the driver 82 which in turn takes place prior to the mounting of the spring 30 just as with the previously described embodiment. Each jaw has a camming surface 118 that is inclined toward axis A in direction toward the wrench end 94 of the driver. The outer end of each jaw camming surface 118 is positioned inwardly sufficiently prior to mounting of the spring 30 to permit the inner surface 116 of the sleeve 86 to receive and move over the jaws to the right so that the locking surfaces 98 and 100 can be engaged axially with each other. An annular camming surface 120 of a frustoconical shape on sleeve 86 engages the jaw camming surfaces 118 to control radial positioning of the jaws. After mounting of the sleeve 86 on the driver, spring 30 having its mounting end 70 and legs 74 like the spring previously described is mounted within a central hole in the driver at the inner extremities of the radial slots 102 so that the spring legs provide an outward bias of the jaws. Mounting of the spring 30 also limits the inward movement of the jaws 34 so that the outer ends of the camming surfaces 118 prevent axial movement of the sleeve 86 toward the left and consequent disassembly of the adjustable socket.

Rotational positioning of the sleeve 86 controls the adjusted position of the jaws 84 between the fully closed position of FIG. 17 and the fully opened position of FIG. 18. In the fully opened position, the locking surfaces 98 and 100 are positioned so that the sleeve 86 is moved axially toward the wrench end 94 of the driver 82 as far as possible. Upon rotation of the sleeve 86 from the position of FIG. 18 toward the position of FIG. 17, the sliding movement of the sleeve helical locking surface 100 along the driver helical locking surface 98 moves the sleeve axially toward the left such that the annular camming surface 120 on the sleeve slidably engages the camming surfaces 118 on the jaws and moves the jaws inwardly against the bias of the legs 74 of spring 30. Rotation of the sleeve 86 in the opposite direction allows the bias of the spring legs 74 to move the jaws outwardly and cam the sleeve toward the wrench end 94 of the driver as the rotation proceeds. The camming surfaces 118 and 120 are perpendicular to the combined radial and axial direction of jaw movement so as to prevent jamming during adjustment of the jaws. Jamming is prevented since the forces applied to the jaws are directed along the direction of movement. The undulated, knurled, or otherwise roughened helical locking surfaces 98 and 100 prevent sleeve rotation upon outward force applied to the jaws 84 during tightening of a nut or bolt of whatever size to which the socket is adjusted.

While preferred embodiments of the best modes for practicing the invention have been described in detail, those familiar with the art to which this invention relates will recognize various alternative designs and embodiments all of which are defined by the following claims.

I claim:

1. An adjustable socket comprising: a driver adapted to be rotatively driven about an axis of rotation thereof; a plurality of jaws mounted on the driver for radial movement with respect to the axis of rotation thereof; each of said jaws including a camming surface that is inclined in a radial direction along the axis of driver rotation; a jaw positioner movable axially on the driver to slidably engage the camming surfaces on the jaws in order to control the radial positions of the jaws and the size of a nut or bolt capable of being received and driven by the jaws under the impetus of driver rotation; a rotatable adjuster for moving the jaw positioner axially in order to move the jaws between fully opened and fully closed positions upon rotation of the adjuster no more than 360° about the axis of driver rotation; and a helical locking surface that extends about the driver axis an angular amount equal to the extent of adjuster rotation so as to provide locking of the adjuster in any adjusted position.

2. An adjustable socket as in claim 1 wherein the jaw positioner includes a sleeve movable axially on the driver, the adjuster having an end on which the helical locking surface is disposed, a helical lcoking surface on the driver for engaging and locking the helical locking surface on the adjuster in any selected position, and a spring for biasing the jaws in an outward radial direction into engagement with the jaw positioner sleeve.

3. An adjustable socket as in claim 1 which includes a unitary sleeve having one end that comprises the jaw positioner and a second end that comprises the adjuster, the helical locking surface being disposed on the second adjuster end of the sleeve, a helical locking surface on the driver that cooperates with the helical locking surface on the adjuster end of the sleeve to provide locking thereof in order to position the jaws, and a spring for biasing the jaws in an outward radial direction into engagement with the jaw positioning end of the sleeve.

4. An adjustable socket comprising: a driver having a jaw support end and also having a wrench end that is adapted to be rotatively driven about an axis of rotation thereof by a wrench; the driver including a helical locking surface that extends about the rotational axis thereof for an angle no greater than 360°; a plurality of jaws mounted on the support end of the driver for radial movement with respect to the axis of driver rotation; each jaw having a camming surface that is inclined radially along the axis of driver rotation; a jaw positioner including a sleeve mounted for axial movement on the driver to slidaly engage the jaw camming surfaces and provide radial positioning of the jaws that controls the size of a nut or bolt that is capable of being received and rotatively driven by the jaws under the impetus of the driver rotation; an adjuster mounted on the driver for axial movement and for rotation an angular extent equal to the angular extent the helical locking surface extends about the axis of driver rotation; the adjuster being engaged with the jaw positioner sleeve to provide axial movement thereof which controls the radial positions of the jaws such that the jaws move radially between fully opened and fully closed positions upon adjuster rotation of no more than one revolution; and the adjuster including a helical locking surface that engages the helical locking surface on the driver to lock the adjuster in any selected rotational position thereof and thereby lock the jaws against outward movement by preventing axial movement of the jaw positioner sleeve.

5. An adjustable socket as in claim 4 wherein the helical locking surface on the driver faces axially toward the wrench end thereof and wherein the helical locking surface on the adjuster faces axially toward the jaws, the camming surfaces on the jaws being inclined inwardly toward the axis of driver rotation in a direction away from the wrench end of the driver, and a spring for biasing the jaws in an outward radial direction such that the inclined camming surfaces thereof engage the jaw positioner sleeve.

6. An adjustable socket as in claim 5 wherein the jaw positioner sleeve includes apertures for receiving the jaws and also includes an annular flange that engages the adjuster.

7. An adjustable socket as in claim 5 or 6 wherein the spring includes a mounting end supported by the driver and a plurality of legs respectively engaged with the jaws to provide the outward bias of the jaws.

8. An adjustable socket comprising: a driver having a jaw support end including radial slots and also having a wrench end that is adapted to be rotatively driven about an axis of rotation thereof by a wrench; the driver including a helical locking surface that faces axially toward the wrench end thereof and extends about the rotational axis thereof for an angle of about 360°; a plurality of jaws received by the radial slots in the support end of the driver for combined radial and axial movement with respect to the axis of driver rotation; each jaw having a camming surface that is inclined inwardly toward the axis of driver rotation in a direction away from the wrench end of the driver; the camming surface of each jaw being generally perpendicular to the combined radial and axial movement thereof; a jaw positioner including a sleeve mounted for axial movement on the driver and having apertures for respectively receiving the jaws the adjacent which the sleeve slidably engages the jaw camming surface upon axial sleeve movement to provide radial positioning of the jaws that controls the size of a nut or bolt that is capable of being received and rotatively driven by the jaws under the impetus of driver rotation; an adjuster mounted on the driver for rotational and axial movement; the adjuster being engaged with the jaw positioner sleeve to provide axial movement thereof which controls the radial positions of the jaws; the adjuster including a helical locking surface that faces axially toward the jaws and engages the helical locking surface on the driver to lock the adjuster in any selected rotational position thereof and thereby lock the jaws against outward movement by preventing axial movement of the jaw positioner sleeve; and a spring that biases the jaws in an outward radial direction into engagement with the jaw positioner sleeve adjacent the apertures whereby the jaws move radially between fully opened and fully closed positions upon adjuster rotation of no more than one revolution.

9. An adjustable socket comprising: a driver having a jaw support end and a wrench end adapted to be rotatively driven about an axis of rotation of the driver; the driver having a helical locking surface that extends about the rotational axis thereof for an angle no greater than 360°; a plurality of jaws mounted on the support end of the driver; each jaw having a camming surface that is inclined radially along the axis of driver rotation; a sleeve that is mounted on the driver for axial and rotational movement; the sleeve including a jaw positioner end that slidably engages the camming surfces of the jaws upon axial movement on the driver to move the jaws radially and thereby adjust the size of a nut or bolt capable of being received and rotatively driven by the jaws under the impetus of driver rotation; and the sleeve also including an adjuster end having a helical locking surface that engages the helical locking surface on the driver to provide locking of the sleeve in any rotational position.

10. An adjustable socket as in claim 9 wherein the helical locking surface on the driver faces axially toward the jaws and wherein the helical locking surface on the adjuster end of the sleeve faces axially toward the wrench end of the driver, the camming surfaces on the jaws being inclined inwardly toward the axis of driver rotation along a direction toward the wrench end of the driver; and a spring for biasing the jaws in an outward radial direction such that the inclined camming surfaces thereof engage the jaw positioner end of the sleeve.

11. An adjustable socket as in claim 10 wherein the jaw positioner end of the sleeve has a frustoconical surface that engages the camming surfces of the jaws.

12. An adjustable socket as in claim 10 or 11 wherein the spring includes a mounting end supported by the driver and a plurality of legs respectively engaged with the jaws to provide the outward bias of the jaws.

13. An adjustable socket as in claim 12 wherein the jaw support end of the driver includes radial jaw slots and each jaw having a mounting lug received by an associated jaw slot in the driver in an axially captured relationship.

14. An adjustable socket comprising: a driver having a jaw support end including radial slots and also having a wrench end adapted to be rotatively driven about an axis of rotation of the driver; the driver having a helical locking surface that faces axially toward the jaw support end of the driver and extends about the rotational axis thereof for an angle of about 360°; a plurality of jaws respectively received by the radial slots in the support end of the driver so as to be mounted for combined radial and axial movement; each jaw having a camming surface that is inclined inwardly toward the axis of driver rotation in a direction toward the wrench end of the driver; the camming surface of each jaw being generally perpendicular to the combined radial and axial movement thereof; a sleeve that is mounted on the driver for axial and rotational movement; the sleeve including a jaw positioner end that slidably engages the camming surfaces of the jaws upon axial movement on the driver to move the jaws radially thereby adjust the size of a nut or bolt capable of being received and rotatively driven by the jaws under the impetus of driver rotation; the sleeve also including an adjuster end having a helical locking surface that faces axially toward the wrench end of the driver and engages the helical locking surface on the driver to provide locking of the sleeve in any rotational position; and a spring that biases the jaws in an outward radial direction into engagement with the jaw positioner end of the sleeve whereby the jaws move radially between fully opened and fully closed positions upon sleeve rotation of no more than one revolution.

* * * * *

UNITED STATES PATENT AND TRADEMARK OFFICE

CERTIFICATE OF CORRECTION

PATENT NO. : 4,213,355

DATED : July 22, 1980

INVENTOR(S) : David S. Colvin

It is certified that error appears in the above—identified patent and that said Letters Patent is hereby corrected as shown below:

Column 1, line 5, "invenstion" should read -- invention --.

line 16, "usuable" should read -- useable --.

line 33, "rotated A" should read -- rotated a --.

Column 1, between lines 54 and 55, insert the title

-- DISCLOSURE OF INVENTION --.

Column 6, line 40, "prssed" should read -- pressed --.

line 53, "positioned" should read -- position --.

Column 8, line 2, "94" should read -- 92 --.

Column 9, line 16, "helical lcoking" should read -- helical locking --.

line 42, "slidaly" should read -- slidably --.

Column 10, line 28, "the adjacent" should read -- and adjacent-.

line 60, "surfces" should read -- surfaces --.

UNITED STATES PATENT AND TRADEMARK OFFICE

CERTIFICATE OF CORRECTION

PATENT NO. : 4,213,355

DATED : July 22, 1980

INVENTOR(S) : David S. Colvin

It is certified that error appears in the above—identified patent and that said Letters Patent is hereby corrected as shown below:

Column 11, line 14, "surfces" should read -- surfaces --.

Column 12, line 14, after "radially" insert -- and --.

Signed and Sealed this

Fourteenth Day of April 1981

[SEAL]

Attest:

RENE D. TEGTMEYER

Attesting Officer

Acting Commissioner of Patents and Trademarks